United States Patent [19]

Przybyła et al.

[11] 4,153,982

[45] May 15, 1979

[54] METHOD AND APPARATUS FOR FORMING CROSS RIBBED PIPES

[75] Inventors: Janusz Przybyła, Zabkowice Bedzińskie; Zygmunt Goździewicz; Józef Stawski, both of Kedzierzyn-Koźle; Józef Pieczyk, Walce; Andrzej Szal, Kędzierzyn-Koźle; Paweł Bodynek, Kędzierzyn-Koźle; Andrzej Mączyński, Kędzierzyn-Koźle, all of Poland

[73] Assignee: Zaklad Doswiadczaln przy Zakladach Urzadzen Chemicznych "Metalchem", Kędzierzyn-Koźle, Poland

[21] Appl. No.: 870,452

[22] Filed: Jan. 18, 1978

[30] Foreign Application Priority Data

Jan. 26, 1977 [PL] Poland ..... 195619

[51] Int. Cl.[2] ..... B21D 53/06

[52] U.S. Cl. ..... 29/157.3 AH; 72/98

[58] Field of Search ..... 72/78, 98; 29/157.3 AH; 165/184

[56] References Cited

U.S. PATENT DOCUMENTS 3,683,656 8/1972 Lewis ..... 29/157.3 AH

*Primary Examiner*—Lowell A. Larson

*Attorney, Agent, or Firm*—Haseltine, Lake & Waters

[57] ABSTRACT

A method and apparatus of forming ribbed pipes, after an initial pipe restressing in which bending of the rib of the plane perpendicular to the rolled pipe axis takes place, and straightening of the rib thenafter. Then on duplex metal pipes, the outside pipe is additionally compressed to the core pipe.

A tool for performing the aforementioned is equipped with a disk section for bending the rib, it is formed of a thrust disk and a straightening disk. When rolling a duplex metal pipe at least one compressing disk is placed therebetween.

4 Claims, 2 Drawing Figures

METHOD AND APPARATUS FOR FORMING CROSS RIBBED PIPES

BACKGROUND OF THE INVENTION

The present invention relates to a method of forming cross ribbed pipes of single and duplex metal structure, for the use in power installation heat exchangers. The invention is also directed to tools for forming a helical pipe rib configuration.

In order to form a cross rib out of pipe material, it is necessary to roll the material with three tools, each consisting of over ten disks of adequate shapes and revolving in relation to the pipe, causing it to rotate and move along its axis. This complex motion of the pipe is forced by a bevel arrangement of driven tool shafts to the pipe axis. During the rolling process, the tool performs the following forming operations: it pinches into the pipe surface, to initiate a first step of extending the rib, forming of the rib shape and; in case of duplex metal pipes, compresses the ribbed metal layer to the core pipe. The tools are provided with rolling disk sections, having the shapes and outside diameters corresponding to the particular operations of rib forming. The first three operations require disks having symmetrical profile shapes, and progressively increasing diameters and work thickness in the rolling direction. The disks performing the last operation are asymmetrical in profile and have a slightly increased diameter in order to compress the ribbed pipe metal to the core pipe. However, the internal stresses in the outside pipe and its ribs, that remain after the rolling process, cause a loosing of the tighteness between the two pipe layers which have on effect upon proper heat transfer into the ribs.

The above described process involves high thrust forces in tool bearings, created mainly at the forming and compressing disks, so that they often deflect under force impulses. This requires a sufficient disk stiffness and thickness, thus limiting the minimum pitch of the helical rib line. To have a reasonable pitch, the tool durability must be decreased, and damage to a single disk results in a production break of a hole rib forming line.

SUMMARY OF INVENTION

The main object of the present invention is to overcome the defects of the prior art.

Another object of the present invention is to form cross ribs on duplex metal pipes by the use of a known method, depending on pipe pinching, extending a rib and its forming through the use of an inventive tool.

The aforementioned objects and advantages of the present invention will be better understood with respect to the accompanying specification, claims and drawings.

IN THE DRAWINGS

DESCRIPTION OF THE INVENTION

After initial pipe restressing, the rib is bent out of the plane perpendicular to the pipe axis by simultaneous compressing the ribbed pipe onto core pipe and again straightening it out. In case of a single metal pipe, the rib formed in a common way is once bent and straightened to the plane perpendicular to the pipe axis.

After an initial rib forming, the pipe is restressed for a moment by removal of the forming load, and is further restressed by rib bending. When forming ribs on duplex metal pipes, a metal joint tighter than before is obtained between the two pipes by simultaneous compression during the rib bending, without increased compression forces. The so formed ribs are dimensionally stable and do not tend to crack by rapid temperature changes in work conditions.

The tool for performing the aforementioned has known symmetric rolling disks, divided in sections for pinching the pipe surface; initial rib extension; and final rib forming. An additional section is provided to bend both sides of the rib. This comprises the following asymmetrical rolling disks; a thrust disk, at least one compression disk spaced from 2 to 6 rib pitches from the latter, and a straightening disk. An alternative tool for forming ribs on single metal pipes contains a disk section for both side bending of ribs and consists of two asymmetrical disks, one for thrust bearing and the other for straightening.

A thrust disk is asymmetrical in shape, and its first face (counted in rolling direction) corresponds to the profile of the last forming disk, and its opposite face is tapered to a cone angle 140° to 170°. The compressing disks are asymmetrical, where the first of them (counted in rolling direction) have one face tapered to a cone angle 155° to 170° and the second face is flat. Subsequent compression disks are of similar shape with alternatively directed faces, whereby the outside diameter of compression disks is increased relative to the outside diameter of forming disks. A straightening disk is also asymmetric in shape, having its first face (counted in rolling direction) tapered to a cone angle of from 155° to 170° and the second face corresponding to the profile of the last forming disk. All the edges of disk profiles are rounded.

The rib stresses alternate in direction and amount in the section of both side bending, thus causing internal stresses created in the forming section to be restrained by the rolling process, so the ribbed pipe is initially restressed when fed through 2 to 6 rib pitches.

By forming the rib shape, heavy loads are directed onto the tool shaft. Most of this load is taken by the thrust disk, the stiffness of which is much greater than the stiffness of forming disk due to its asymmetrical profile. As a result, there is no deflection of the tool, tool durability is high, and the formation of disks can be accomplished with a lower thickness and in smaller spaces, resulting in a ribbed pipe of small pitch.

Figure 1:
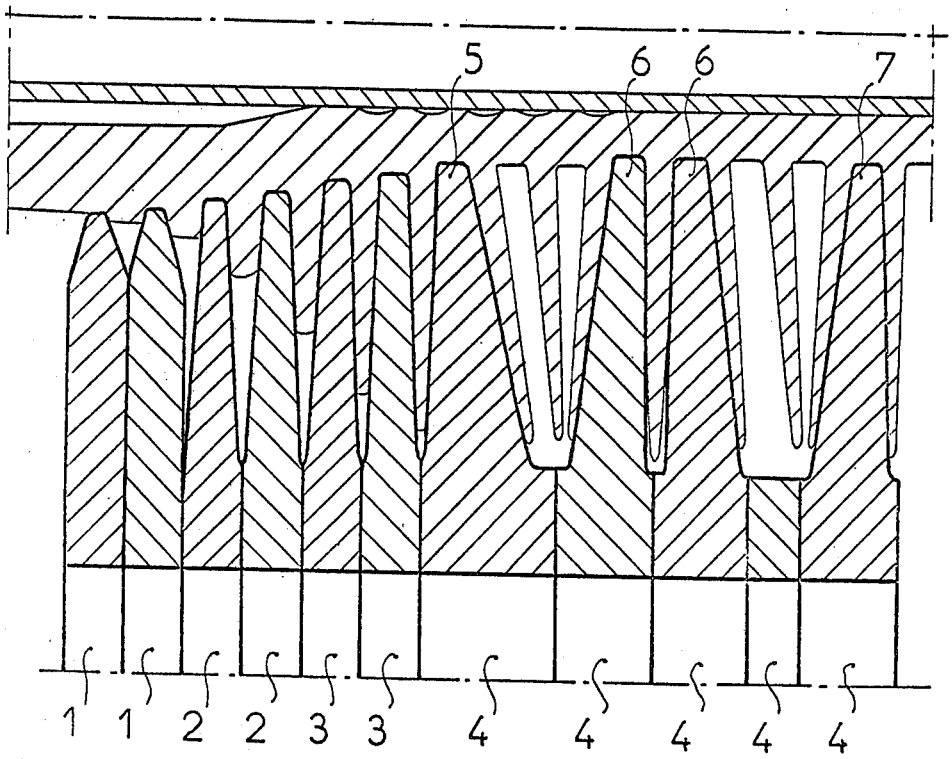
FIG. 1 illustrates in partial cross section the tool for forming cross ribbed duplex metal pipes.
Figure 2:
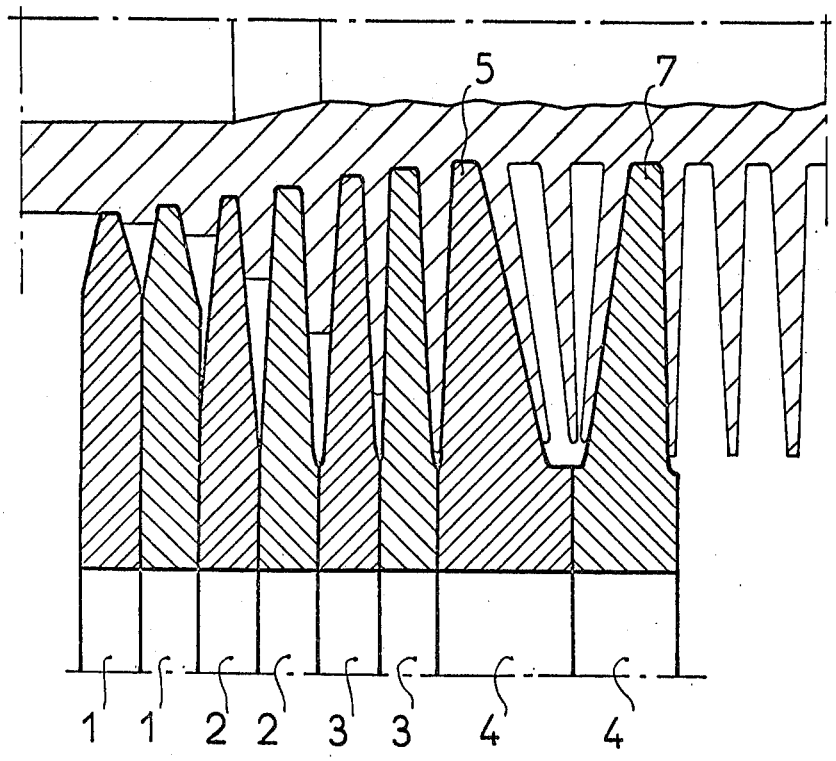
FIG. 2 illustrates a view similar to FIG. 1 for forming simple metal pipe.

As shown in FIGS. 1 and 2, the tool of the present invention consists of symmetrical disks in section 1 for pinching; in section 2 for initial rib extending, and in section 3 for final rib forming. Section 4 for both side rib bending includes, asymmetrical disks: a thrust disk 5, two compressing disks 6 and a straightening disk 7.

Most of the axial load created by rib forming is carried by the thrust disk 5 onto the tool shaft. A stable configuration of disk 5, a face of which corresponds to the rib shape and the other of which is tapered to a cone angle 140° to 170°, enables heavy loads to be taken over and at the same time affords the possibility of forming high ribs. The tapered face of disk 5 bends the rib out of its normal position and the rib comes under the influence of compression disks 6, each of which urges the rib to bend out of the plane perpendicular to the rolling axis and compresses the ribbed pipe on the core pipe.

Between the thrust disk 5 and the first of compression disks 6, there is left a space of three pitches without rolling disks. During the pipe feed through the empty space of three pitches, the pipe initially relaxes, resulting in a more tight joint to the core pipe during compression. Rib bending removes internal stresses collected in the ribs. The so formed pipes have in dimensions and do not exhibit cracks due to rapid temperature changes in work conditions.

Many modifications and variations of the present invention are possible in light of the above teachings. It is, therefore, to be understood that within the scope of the appended claims, the invention may be practiced otherwise than as particularly described.

We claim:

1. A method of forming cross ribbed pipes of duplex metal structure in a rolling process by pinching action on the pipe surface, initial rib extending and forming the rib shape, comprising the steps of: initially restressing a formed pipe rib; bending said pipe rib several times out of a plane perpendicular to a rolling axis by simultaneously compressing said ribbed pipe to a core pipe, and straightening said rib.

2. A method of forming cross ribbed pipes of simple metallic structure by rolling, including pinching the pipe surface, initial rib extending and forming a rib shape, and comprising the steps of: forming a pipe rib by bending said rib out of the plane perpendicular to the rolling axis, and then straightening said rib.

3. A tool for forming cross ribbed pipes of duplex metal structure, employing symmetrical disks arranged in sections adapted to pinch a surface of said pipe, initially extend and forming the rib shape, wherein: said tool being defined by an additional section of asymmetrical rolling disks for rib bending on both sides, said tool comprising: a thrust disk having the first of its faces in the rolling direction in a shape corresponding to a last forming disk profile, and its second face tapered to a cone angle of 140° to 170°; at least one compressing disk apart of said thrust disk at 2 to 6 rib pitches, having one face tapered to a cone angle of 155° to 170°, another face flat, whereby the first of said compressing disks has said tapered face directed opposite to a pipe feed direction and subsequent compression disks being alternatively arranged; said compressing disks being formed with outside diameters a little larger that said diameters of the last forming disks; a straightening disk with one face in rolling direction tapered to having a cone angle of 155° to 170° and its rear face corresponding to last forming disk profile.

4. A tool for forming cross ribbed pipes of simple metal structure employing symmetrical disks arranged in sections for pinching of pipe surfaces, initial rib extending and forming a rib shape, wherein: said tool being defined by an additional section of asymmetrical disks for rib bending, said tool comprising: a thrust disk having the first of its faces in a rolling direction of a shape corresponding to the last forming disk profile, and its second face tapered to a cone angle of 140° to 170°; a straightening disk, facing the pipe feed having its side tapered to a cone angle of 155° to 170° and having its rear face corresponding to the last forming disk profile.

* * * * *